US011320131B1

(12) United States Patent
Li et al.

(10) Patent No.: US 11,320,131 B1
(45) Date of Patent: May 3, 2022

(54) FIRE RESISTANT LED MODULE AND MANUFACTURING METHOD THEREOF

(71) Applicant: SHENZHEN XINGHE PIXEL ELECTRONICS CO., LTD, Shenzhen (CN)

(72) Inventors: Sheng Li, Shenzhen (CN); Jie Zhou, Shenzhen (CN); Guangming Song, Shenzhen (CN); Youhe Zhang, Shenzhen (CN)

(73) Assignee: SHENZHEN XINGHE PIXEL ELECTRONICS CO., LTD, Shenzhen (CN)

( * ) Notice: Subject to any disclaimer, the term of this patent is extended or adjusted under 35 U.S.C. 154(b) by 0 days.

(21) Appl. No.: 17/389,392

(22) Filed: Jul. 30, 2021

(30) Foreign Application Priority Data

Jun. 19, 2021 (CN) ..... 202110681793.8

(51) Int. Cl.
*F21V 25/12* (2006.01)
*F21V 23/00* (2015.01)
*F21V 19/00* (2006.01)
*F21Y 115/10* (2016.01)

(52) U.S. Cl.
CPC ..... *F21V 25/12* (2013.01); *F21V 19/005* (2013.01); *F21V 23/005* (2013.01); *F21Y 2115/10* (2016.08)

(58) Field of Classification Search
CPC ..... F21V 25/12; F21V 19/005; F21V 23/005
See application file for complete search history.

(56) References Cited

U.S. PATENT DOCUMENTS

2014/0192529 A1* 7/2014 Wilcox ..... F21V 29/763 362/244
2015/0008455 A1* 1/2015 Tozawa ..... H05K 13/00 264/272.14
2015/0330610 A1* 11/2015 Song ..... F21V 21/145 362/6
2018/0135846 A1* 5/2018 Chen ..... F21V 17/16

* cited by examiner

*Primary Examiner* — Evan P Dzierzynski

(57) ABSTRACT

The present disclosure provides a fire resistant LED module, including a metal mask and a printed circuit board (PCB). A layer of flame-retardant glue is coated on one side, facing the PCB, of the metal mask, and the metal mask is pasted with the PCB through the flame-retardant glue. A sub-black insulating surface layer is disposed on the metal mask. The present disclosure further provides a manufacturing method of the fire resistant LED module, including following steps: processing surfaces of the metal mask after etching to form the sub-black insulating surface layer; coating the flame-retardant glue on one surface of the metal mask facing the PCB; and covering the metal mask on the PCB through the flame-retardant glue. The sub-black insulating surface layer is formed through processing the surfaces of the metal mask 1.

10 Claims, 4 Drawing Sheets

FIRE RESISTANT LED MODULE AND MANUFACTURING METHOD THEREOF

TECHNICAL FIELD

The present disclosure relates to a technical field of LED modules, in particular to a fire resistant LED module and manufacturing method thereof.

BACKGROUND

In order to ensure display effect of LED display screens, surfaces of an LED module are processed to remove reflection and color difference of a printed circuit board (PCB) in each LED gap of the LED module. An ordinary process is to paste a layer of rubber or plastic mask on the surfaces of the LED module, fill a gap of the LED with the mask, and cover the PCB to eliminate reflection and chromatic aberration. However, as an application range of the LED display screens expands, in some specific situations, the LED display screens also need to have a higher level of fire resistant function, and the rubber or plastic mask does not have the fire resistant function.

Chinese patent No. CN 212990567 U discloses an LED display screen and a mask thereof, where the mask is used with an LED display module of the LED display screen. The mask includes a main body and a coating containing a flame retardant, at least one accommodating part is disposed on the main body, the accommodating part is configured to accommodate LED lamp beads on the LED display module, so that the main body is attached to the LED display module, and the coating is covered on surfaces of the main body. Since the surfaces of the main body are covered with the coating, and the coating contains the flame retardant, so that the coating has good flame retardant performance, thereby effectively improving fire resistant performance of the mask. However, the mask is complex in structure and complex in production process. Thus, there is a need for an LED module having a simple production process and having optical performance.

SUMMARY

Based on above, it is necessary to provide an LED module and a manufacturing method thereof for the problem of the LED display screen, which has a simple production process and a good fire resistant effect.

The present disclosure provides a fire resistant LED module, including a metal mask and a printed circuit board (PCB). A plurality of LED lamp beads distributed at intervals are disposed on one surface of the PCB, and a plurality of mounting grooves matched with the LED lamp beads are disposed on the metal mask. A layer of flame-retardant glue is coated on one side, facing the PCB, of the metal mask, the metal mask is pasted with the PCB through the flame-retardant glue, and each of the LED lamp beads is disposed on the respective mounting groove. A sub-black insulating surface layer is disposed on the metal mask.

Optionally, the metal mask is an aluminum mask or steel mask or stainless steel mask.

Optionally, thickness of the metal mask is 0.5-0.7 mm.

Optionally, the thickness of the metal mask is 0.6 mm.

Optionally, the plurality of LED lamp beads are distributed in a rectangular array on the PCB.

The present disclosure further provides a manufacturing method of the fire resistant LED module, including following steps: performing an etching process on the metal mask according to arrangement of the plurality of the LED lamp beads on the PCB, and forming the mounting grooves for accommodating the plurality of the LED lamp beads in the metal mask; processing surfaces of the metal mask after etching to form the sub-black insulating surface layer; coating the flame-retardant glue on one surface of the metal mask where the PCB pastes with; and covering the metal mask on the PCB through the flame-retardant glue.

The above manufacturing method of the fire resistant LED module adopts metal as materials of the fire resistant mask since the metal is non-combustible in air and has corrosion resistance after surface processing. The sub-black insulating surface layer is formed through processing the surfaces of the metal mask, which surface consistency is good and absorbs ambient light and further improves contrast of the fire resistant LED module. The metal mask is etched and processed, so that the mounting grooves for accommodating the plurality of the LED lamp beads formed in the metal mask have a high precision and are more suitable for the fire resistant LED module. The metal mask is pasted with the PCB through the flame-retardant glue, and flame-retardant property is strong.

DETAILED DESCRIPTION

In order to make above-mentioned objects, features and advantages of the present disclosure more obvious and understandable, the specific embodiments of the present disclosure are described in details below in conjunction with the accompanying drawings. In the following description, many specific details are set forth to facilitate a full understanding of the present disclosure. However, the present disclosure can be implemented in many other ways than those described herein, and those who skilled in the art can make similar improvements without contradicting the content of the present disclosure, so that the present disclosure is not limited by the specific embodiments disclosed below.

In the description of the present disclosure, it should be understood that the terms "center", "longitudinal", "transverse", "length", "width", "thickness", "up", "low", "front", "back", "left", "right", "vertical", "horizontal", "top", "bottom", "inside", "outside", "clockwise", "counterclockwise", "axial", "radial", "circumferential", etc. indicate orientation or positional relationships based on the orientation or positional relationships shown in the accompanying drawings and are intended only to facilitate and simplify the description of the present disclosure, not to indicate or imply that the device or element referred to must have a particular orientation, be constructed and operate in a particular orientation, and therefore are not to be construed as a limitation of the present disclosure.

Figure 1:
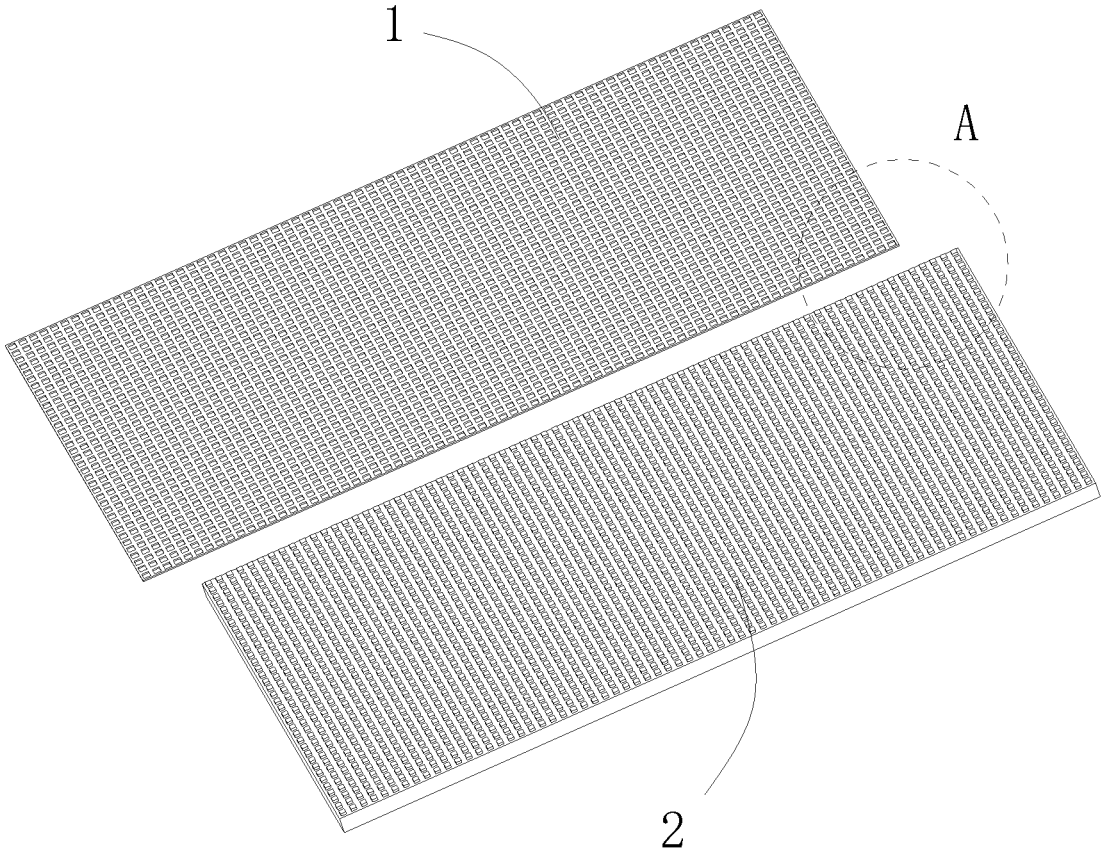
FIG. 1 is a structural schematic diagram of a fire resistant LED module according to one embodiment of the present disclosure.
Figure 2:
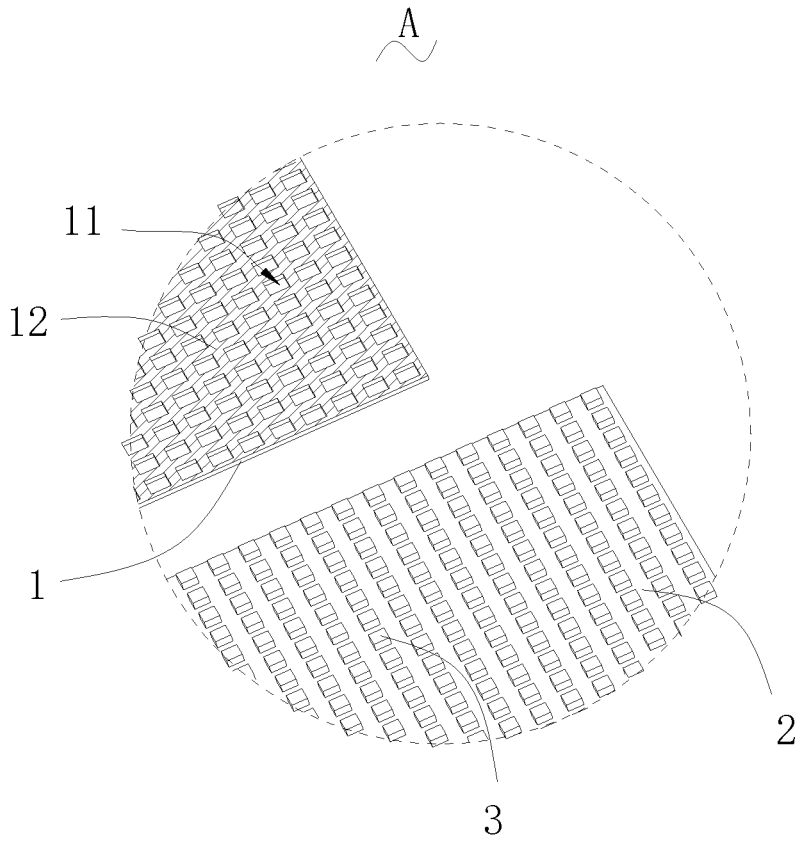
FIG. 2 is a partial enlarged diagram of portion A shown in FIG. 1.
Figure 3:
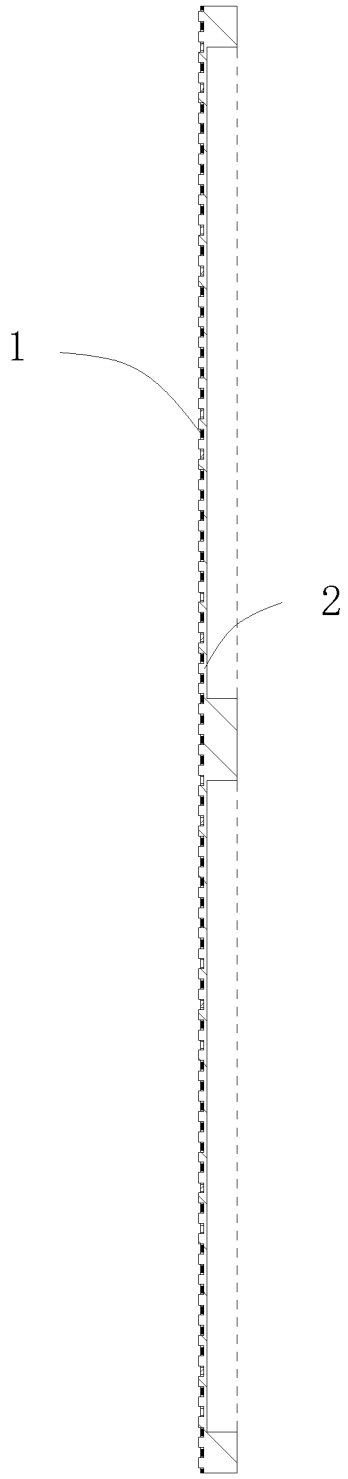
FIG. 3 is a cross-sectional structural schematic diagram of the fire resistant LED module according to one embodiment of the present disclosure.

As shown in FIGS. 1-3, the present disclosure provides a fire resistant LED module, including a metal mask 1 and a printed circuit board 2. A plurality of LED lamp beads 3 distributed at intervals are disposed on one surface of the PCB 2, and a plurality of mounting grooves 11 matched with the LED lamp beads 3 are disposed on the metal mask 1. A layer of flame-retardant glue (not shown in the drawings) is coated on one side, facing the PCB 2, of the metal mask 1, the metal mask 1 is pasted with the PCB 2 through the flame-retardant glue, and each of the LED lamp beads 3 is disposed on the respective mounting groove 11. Surfaces of the metal mask 1 are processed, and a sub-black insulating surface layer is disposed on the surfaces the metal mask.

The metal mask is an aluminum mask or steel mask or stainless steel mask. For example, the metal mask 1 is the aluminum mask, and surfaces of the aluminum mask are anodized to form a sub-black insulating surface layer. As another example, the metal mask 1 is the steel mask or the stainless steel mask, and surfaces of the steel mask or the stainless steel mask is processed through spraying sub-black powder to form a sub-black insulating surface layer.

In one embodiment, the plurality of LED lamp beads 3 are distributed in a rectangular array on the PCB 2. Specifically, the LED lamp beads 3 on the PCB 2 are distributed in the rectangular array, each of the LED lamp beads 3 is guaranteed to be accommodated in the respective mounting groove 11, so that all the LED lamp beads 3 on the PCB 2 are blocked, and light crosstalk between the LED lamp beads 3 is reduced, which improves a display effect of the fire resistant LED module.

For example, thickness of the metal mask is 0.5-0.7 mm. For example, the thickness of the metal mask is 0.6 mm.

Figure 4:
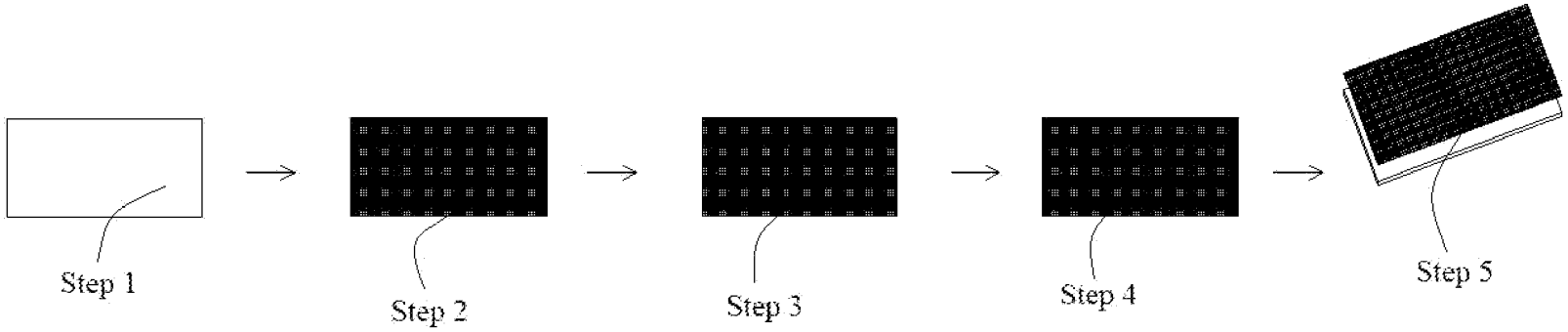
FIG. 4 is a flowchart of a manufacturing method of the fire resistant LED module according to one embodiment of the present disclosure.

As shown in FIG. 4, the present disclosure further provides a manufacturing method of the fire resistant LED module, including following steps.

Step 1: forming the metal mask 1 matched with the PCB 2 according to a size and a shape of the PCB 2 through using a thin metal (aluminum/steel/stainless steel) having thickness of 0.5-0.7 mm. The above metal is non-combustible in air and has corrosion resistance after surface processing.

Step 2: performing an etching process on the metal mask 1 according to arrangement of the plurality of the LED lamp beads 3 on the PCB 2, and forming the mounting grooves 11 for accommodating the plurality of the LED lamp beads 3 in the metal mask 1.

Step 3: processing surfaces of the metal mask 1 after etching to form the sub-black insulating surface layer. The sub-black insulating surface layer has good light absorption performance and low reflection of ambient light, absorbs light rays on the surface of the metal mask 1, improves contrast of the fire resistant LED module, and further prevents the surfaces of the metal mask 1 from occurring dazzle lights. Meanwhile, since the insulating surface layer is sub-black, surface consistency is good. Further, in the surface processing steps, the surfaces of the aluminum mask are anodized to form the sub-black insulating surface layer, and the surfaces of the steel mask or the stainless steel mask is processed through spraying sub-black powder to form the sub-black insulating surface layer.

Step 4: coating the flame-retardant glue on one surface of the metal mask 1 facing the PCB 2.

Step 5: covering the metal mask 1 on the PCB 2 through the flame-retardant glue to further enhance flame-retardant performance.

The above manufacturing method of the fire resistant LED module adopts metal (aluminum/steel/stainless steel) as materials of the fire resistant mask, the above metal is non-combustible in air and has corrosion resistance after surface processing. The sub-black insulating surface layer is formed through processing the surfaces of the metal mask 1 (the surfaces of the aluminum mask is anodized to form the sub-black insulating surface layer, and the surfaces of the steel mask or the stainless steel mask is processed through spraying sub-black powder to form the sub-black insulating surface layer). The sub-black insulating surface layer has the good light absorption performance and low reflection of ambient light, absorbs the light rays on the surface of the metal mask 1, improves the contrast of the fire resistant LED module, and further prevents the surfaces of the metal mask 1 from occurring the dazzle lights. Meanwhile, since the insulating surface layer is sub-black, the surface consistency is good. The metal mask 1 is etched and processed, so that the mounting grooves 11 for accommodating the plurality of the LED lamp beads 3 formed in the metal mask 1 have a high precision and are more suitable for the fire resistant LED module. The metal mask 1 is pasted with the PCB 2 through the flame-retardant glue, and flame-retardant property is strong.

The above described embodiments express only several embodiments of the present disclosure, which are described in a more specific and detailed manner, but they should not be construed as a limitation of patent scopes of the present disclosure. It should be noted that for those who skilled in the art, a number of deformations and improvements can be made without departing from the conception of the present disclosure, which all belong to scopes of protection of the present disclosure. Therefore, the scopes of protection of the patent of the present disclosure shall be subject to the attached claims.

What is claimed is:

1. A fire resistant LED module, comprising:

a metal mask; and a printed circuit board (PCB);

wherein a plurality of LED lamp beads distributed at intervals are disposed on one surface of the PCB, and a plurality of mounting grooves matched with the LED lamp beads are disposed on the metal mask; a layer of flame-retardant glue is coated on one side, facing the PCB, of the metal mask, the metal mask is pasted with the PCB through the flame-retardant glue, and each of the LED lamp beads is disposed on the respective mounting groove; and a sub-black insulating surface layer is disposed on the metal mask.

2. The fire resistant LED module according to claim 1, wherein the metal mask is an aluminum mask or steel mask or stainless steel mask.

3. A manufacturing method of the fire resistant LED module according to claim according to claim 2, comprising:

performing an etching process on the metal mask according to arrangement of the plurality of the LED lamp beads on the PCB, and forming the mounting grooves for accommodating the plurality of the LED lamp beads in the metal mask;

processing surfaces of the metal mask after etching to form the sub-black insulating surface layer;

coating the flame-retardant glue on one surface of the metal mask where the PCB pastes with; and covering the metal mask on the PCB through the flame-retardant glue.

4. The fire resistant LED module according to claim 1, wherein thickness of the metal mask is 0.5-0.7 mm.

5. The fire resistant LED module according to claim 4, wherein the thickness of the metal mask is 0.6 mm.

6. A manufacturing method of the fire resistant LED module according to claim according to claim 5, comprising:

performing an etching process on the metal mask according to arrangement of the plurality of the LED lamp beads on the PCB, and forming the mounting grooves for accommodating the plurality of the LED lamp beads in the metal mask;

processing surfaces of the metal mask after etching to form the sub-black insulating surface layer;

coating the flame-retardant glue on one surface of the metal mask where the PCB pastes with; and covering the metal mask on the PCB through the flame-retardant glue.

7. A manufacturing method of the fire resistant LED module according to claim according to claim 4, comprising:

performing an etching process on the metal mask according to arrangement of the plurality of the LED lamp beads on the PCB, and forming the mounting grooves for accommodating the plurality of the LED lamp beads in the metal mask;

processing surfaces of the metal mask after etching to form the sub-black insulating surface layer;

coating the flame-retardant glue on one surface of the metal mask where the PCB pastes with; and covering the metal mask on the PCB through the flame-retardant glue.

8. The fire resistant LED module according to claim 1, wherein the plurality of LED lamp beads are distributed in a rectangular array on the PCB.

9. A manufacturing method of the fire resistant LED module according to claim according to claim 8, comprising:

performing an etching process on the metal mask according to arrangement of the plurality of the LED lamp beads on the PCB, and forming the mounting grooves for accommodating the plurality of the LED lamp beads in the metal mask;

processing surfaces of the metal mask after etching to form the sub-black insulating surface layer;

coating the flame-retardant glue on one surface of the metal mask where the PCB pastes with; and covering the metal mask on the PCB through the flame-retardant glue.

10. A manufacturing method of the fire resistant LED module according to claim 1, comprising:

performing an etching process on the metal mask according to arrangement of the plurality of the LED lamp beads on the PCB, and forming the mounting grooves for accommodating the plurality of the LED lamp beads in the metal mask;

processing surfaces of the metal mask after etching to form the sub-black insulating surface layer;

coating the flame-retardant glue on one surface of the metal mask where the PCB pastes with; and covering the metal mask on the PCB through the flame-retardant glue.

* * * * *